US011149982B2

(12) United States Patent
Bang et al.

(10) Patent No.: US 11,149,982 B2
(45) Date of Patent: Oct. 19, 2021

(54) AIR CONDITIONER

(71) Applicant: LG ELECTRONICS INC., Seoul (KR)

(72) Inventors: Kisuk Bang, Seoul (KR); Sangyuk Son, Seoul (KR); Kyungjung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 450 days.

(21) Appl. No.: 16/386,444

(22) Filed: Apr. 17, 2019

(65) Prior Publication Data

US 2019/0323730 A1 Oct. 24, 2019

(30) Foreign Application Priority Data

Apr. 18, 2018 (KR) ..... 10-2018-0044998

(51) Int. Cl.
*F24F 13/30* (2006.01)
*F24F 13/20* (2006.01)
(Continued)

(52) U.S. Cl.
CPC ..... *F24H 3/022* (2013.01); *F24F 1/0035* (2019.02); *F24F 1/0047* (2019.02); *F24H 3/0411* (2013.01); *F24H 3/062* (2013.01); *F24H 9/0052* (2013.01); *H05B 3/06* (2013.01); *H05B 3/20* (2013.01); *F24F 13/20* (2013.01); *F24F 2221/14* (2013.01); *F24F 2221/34* (2013.01);
(Continued)

(58) Field of Classification Search
None
See application file for complete search history.

(56) References Cited

U.S. PATENT DOCUMENTS 3,171,399 A * 3/1965 Kirgan ..... F24H 3/067 126/110 B
4,449,376 A * 5/1984 Draper ..... F25B 29/003 62/259.1
(Continued)

FOREIGN PATENT DOCUMENTS

JP 60-039831 3/1985
JP 5-71756 3/1993
(Continued)

OTHER PUBLICATIONS

European Search Report dated Sep. 17, 2019.

*Primary Examiner* — Joseph M. Pelham
(74) *Attorney, Agent, or Firm* — Ked & Associates LLP

(57) ABSTRACT

An air conditioner may include a casing having an inner air flow space defined therein and an entrance defined in one of a first side plate or a second side plate, a heat exchanger and a fan disposed between an outdoor air inlet body and an air outlet body in an air flow direction of the casing, a heater module inserted through the entrance into the inner air flow space, a handle mounted on one side face among both side faces of the heater module, one side face of the both side faces being closer to the entrance than the other side face thereof, a pair of guide brackets installed in the casing to slidably guide the heater module, and a door module that opens and closes the entrance. The door module may be configured to contact the handle to press the handle in a direction away from the entrance.

20 Claims, 9 Drawing Sheets

(51) Int. Cl.

| | |
|---|---|
| ***F24F 3/04*** | (2006.01) |
| ***H05B 3/06*** | (2006.01) |
| ***F24H 3/02*** | (2006.01) |
| ***F24F 1/0035*** | (2019.01) |
| ***F24F 1/0047*** | (2019.01) |
| ***F24H 3/06*** | (2006.01) |
| ***H05B 3/20*** | (2006.01) |
| ***F24H 3/04*** | (2006.01) |
| ***F24H 9/00*** | (2006.01) |

(52) U.S. Cl.
CPC .... *F24F 2221/36* (2013.01); *H05B 2203/022* (2013.01)

(56) References Cited

U.S. PATENT DOCUMENTS 4,459,466 A * 7/1984 Nakagawa ..... G05D 23/2401 165/103
4,737,616 A * 4/1988 Wen-Ying ..... F24H 3/0417 219/472
4,951,737 A * 8/1990 Tenhundfeld ..... F24F 1/027 165/58
5,277,036 A * 1/1994 Dieckmann ..... F24F 3/044 165/76
5,582,026 A * 12/1996 Barto, Sr. ..... F24F 1/50 62/298
2002/0117296 A1* 8/2002 Smith ..... B60H 1/00028 165/202
2003/0094010 A1 5/2003 Katatani et al.
2007/0292941 A1* 12/2007 Handique ..... B01L 3/50273 435/288.7
2014/0044424 A1* 2/2014 Michaud ..... F24H 9/1863 392/360
2020/0173687 A1* 6/2020 Zhou ..... F24H 9/0063

FOREIGN PATENT DOCUMENTS

KR 20-1999-0021149 6/1999
KR 10-2018-0034981 4/2018

* cited by examiner

AIR CONDITIONER

CROSS-REFERENCE TO RELATED APPLICATION(S)

This application claims a benefit under 35 U.S.C. § 119(a) of Korean Patent Application No. 10-2018-0044998, filed in Korea on Apr. 18, 2018, the entire disclosure of which is incorporated herein by reference for all purposes.

BACKGROUND

1. Field

An air conditioner, and more particularly, an air conditioner having a heater module for heating air are disclosed herein.

2. Background

An air conditioner suctions air in a room, changes a temperature, humidity, and cleanliness, for example, of the suctioned air, and discharges the suctioned air back into the room. The air conditioner may include a heat exchanger through which a medium, such as a refrigerant, and cooling water, for example, passes, and a fan that suctions the air in the room and blows the suctioned air to the heat exchanger.

The air conditioner may have an air inlet through which the air in the room is suctioned, and an air outlet through which the air that is heat exchanged with the heat exchanger is discharged. When the fan is driven, the air in the room may be suctioned into the air conditioner through the air inlet. Then, the air may flow to the heat exchanger, and may be heat exchanged with the heat exchanger. Then, the air may be discharged outside the air conditioner through the air outlet.

The air conditioner is capable of suctioning the air in the room, heating or cooling the suctioned air, and then discharging the heated or cooled air back into the room. The air conditioner is also capable of suctioning outdoor air, and discharging the suctioned outdoor air to the room after heating or cooling the suctioned outdoor air.

As described above, the air conditioner that suctions the outdoor air, conditions the outdoor air, and discharges the outdoor air to the room may be mounted on a ceiling or in a machine room, and may be connected to the room through the outlet duct. The air conditioner as described above may include both the heat exchanger through which the medium, such as the coolant, and the cooling water, for example, passes, and a heater module that heats air flowing toward the heat exchanger. The air heated by the heater module may be discharged to the room after heat exchanging with the heat exchanger while passing through the heat exchanger.

BRIEF DESCRIPTION OF THE DRAWINGS

Embodiments will be described in detail with reference to the following drawings in which like reference numerals refer to like elements and, wherein.

DETAILED DESCRIPTION

Figure 1:
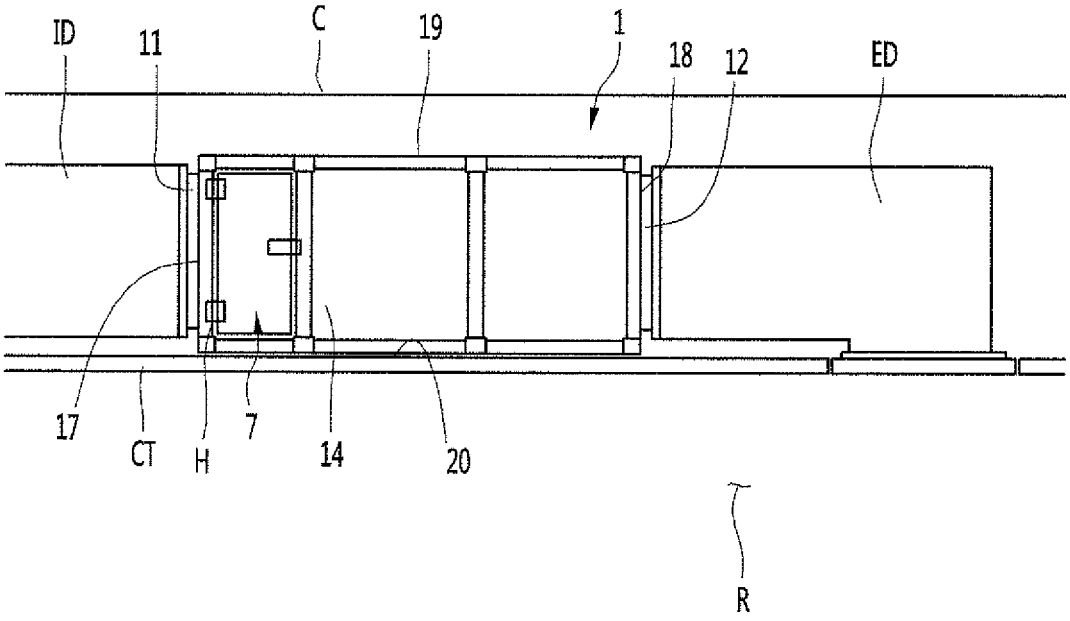
FIG. 1 is a side view of an air conditioner according to an embodiment when mounted on a ceiling.

Hereinafter, embodiments will be described with reference to drawings. Wherever possible, like reference numerals have been used to indicate like elements, and repetitive disclosure has been omitted.

Figure 2:
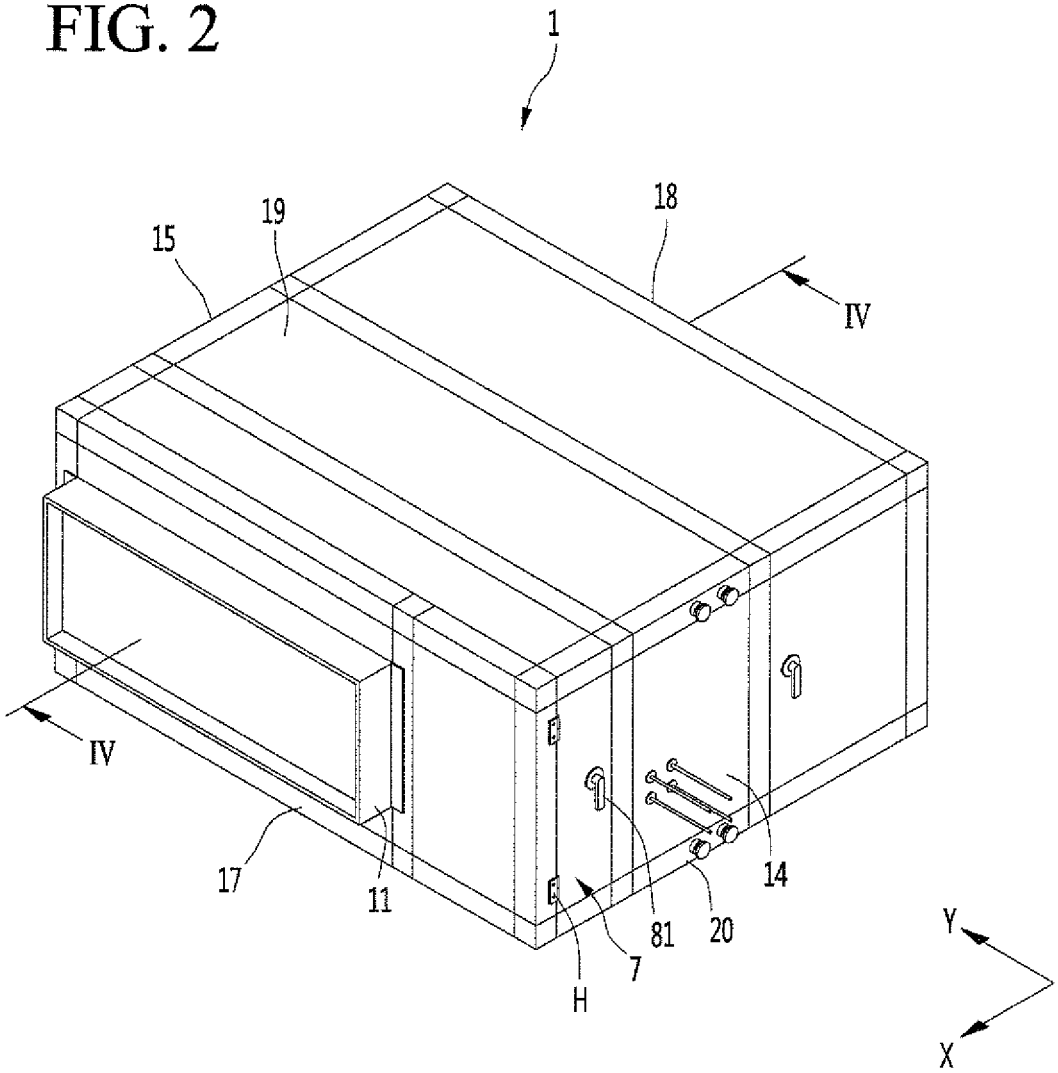
FIG. 2 is a perspective view of an air conditioner according to an embodiment.
Figure 3:
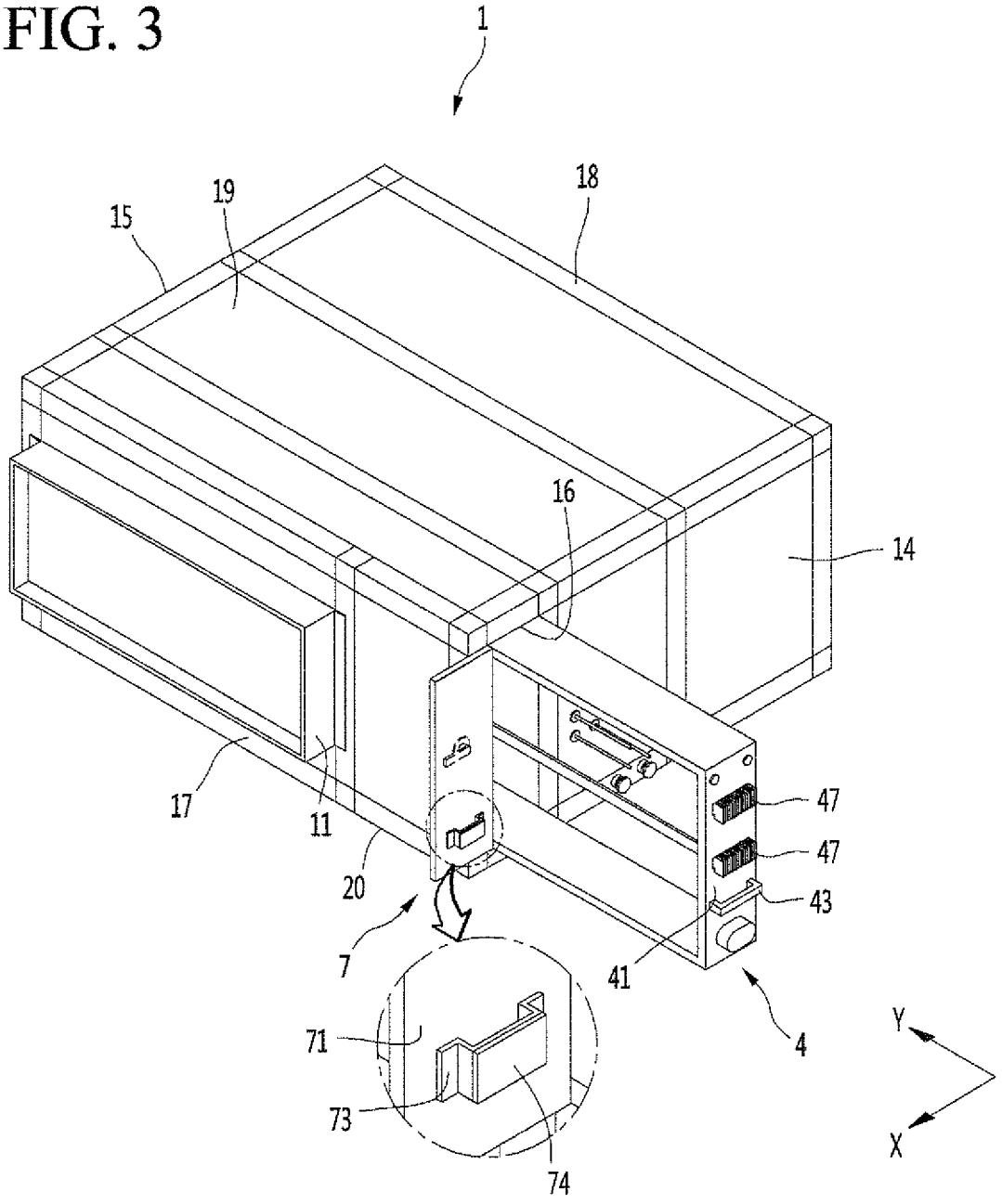
FIG. 3 is a perspective view of an air conditioner according to an embodiment when a door module is opened and a heater module enters an entrance.
Figure 4:
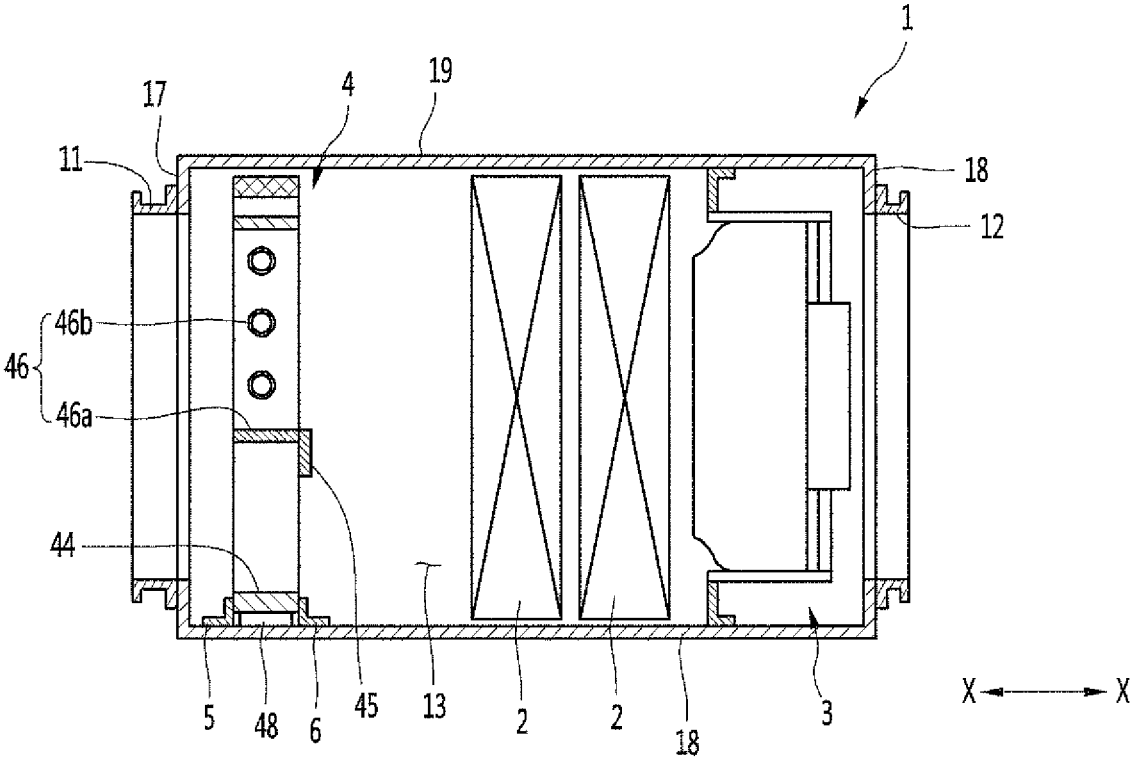
FIG. 4 is a cross-sectional view taken along a line IV-IV shown in FIG. 2.

FIG. 1 is a side view of an air conditioner according to an embodiment when mounted on a ceiling. FIG. 2 is a perspective view of an air conditioner according to an embodiment. FIG. 3 is a perspective view of an air conditioner according to an embodiment when a door module is opened and a heater module enters an entrance. FIG. 4 is a cross-sectional view taken along a line lV-IV shown in FIG. 2.

As shown in FIG. 1, an air conditioner may be disposed in a space beween a ceiling C and a ceiling tex CT, communicate with outside of a building through an inlet duct ID, and may be connected to a room R through an outlet duct ED and a diffuser D. The air conditioner may suction air outside the building (hereinafter referred to as "outdoor air") through the inlet duct ID. The air conditioner may condition the suctioned outdoor air with a heater module 4 and a heat exchanger 2, and then discharge the conditioned air via the outlet duct ED to the room R.

The air conditioner may include a casing 1, the heat exchanger 2, a fan 3, the heater module 4, a pair of guide brackets 5 and 6, and a door module 7. An outdoor air inlet body 11 and an air outlet body 12 may be formed on the casing 1. The casing 1 may have an inner air flow space 13 defined therein. The casing 1 may be a combination of a plurality of members, and may be in a form of a hexahedron as a whole, for example. The casing 1 may include a left or first side plate 14, a right or second side plate 15, an outdoor air suctioning plate 17, an air discharge plate 18, a top plate 19, and a bottom plate 20. The outdoor air inlet body 11 and the air outlet body 12 may be formed in addition to the left side plate 14 and the right side plate 15.

The casing 1 may include the outdoor air suctioning plate 17 to which the outdoor air inlet body 11 may be coupled and the air discharge plate 18 to which the air outlet body 12 may be coupled. The outdoor air suctioning plate 17 and the air discharge plate 18 may be arranged facing away from each other. The outdoor air suctioning plate 17 and the air discharge plate 18 may be orthogonal to the left side plate 14 and the right side plate 15, respectively.

One of the outdoor air suctioning plate 17 and the air discharge plate 18 may be a front plate and the other may be a rear plate. The top plate 19 and the bottom plate 20 may be orthogonal to the left side plate 14 and the right side plate 15, respectively, and may be orthogonal to the outdoor air suctioning plate 17 and the air discharge plate 18, respectively.

The outdoor air inlet body 11 may be connected to the inlet duct ID (see FIG. 1) that guides the outdoor air into the casing 1. The air outlet body 12 may be connected to the outlet duct ED (see FIG. 1) that guides the air heated or cooled inside the casing 1 to the room.

The casing 1 may have an entrance 16 (see FIG. 3) defined in one of the left side plate 14 or the right side plate 15. The entrance 16 may be defined to be larger than the heater module 4. The entrance 16 may be defined in any one of the left side plate 14 and the right side plate 15, and may be opened in a direction (Y direction) perpendicular to an air flow direction (X direction).

An operator may position the heater module 4 next to the entrance 16 and then mount the heater module 4 in the casing 1 through the entrance 16. Further, the operator may hold the heater module 4 mounted inside the casing 1 and draw the heater module 4 through the entrance 16 to next to the entrance 16.

The heat exchanger 2 and the fan 3 may be disposed between the outdoor air inlet body 11 and the air outlet body 12, as shown in FIG. 4. The heat exchanger 2 may include a tube through which a medium such as refrigerant, cold water, and hot water, for example, passes, and may heat or cool the air passing through the space 13 of the casing 1.

The fan 3 may be disposed between the outdoor air inlet body 11 and the heat exchanger 2 or between the heat exchanger 2 and the air outlet body 12. In addition, the fan 3 may suction the outdoor air into the space 13 of the casing 1 and pass the suctioned outdoor air through the heat exchanger 2. Then, the fan 3 may discharge the outdoor air that is heat exchanged with the heat exchanger 2.

The heater module 4 may be inserted through the entrance 16 into the space 13. The heater module 4 may be disposed in front of the heat exchanger 2 in the air flow direction in the casing 1. When the heat exchanger 2 functions as a heat exchanger 2 for heating the air, the heater module 4 may function as a preheater to heat the outdoor air flowing towards the heat exchanger 2.

A handle 43 may be provided on one side surface 41 (see FIG. 3) closer to the entrance 16 among both side faces of the heater module 4. The handle 43 may be formed on one side of left or first and right or second sides of the heater module 4. The handle 43 may be mounted on the side face 41 closer to the entrance 16 among the both side faces of the heater module 4 in a protruding manner.

The pair of guide brackets 5 and 6 may be installed in the casing 1 as shown in FIG. 4. The pair of guide brackets 5 and 6 may slidably guide the heater module 4 in the direction (Y direction) perpendicular to the air flow direction (X direction).

The pair of guide brackets 5 and 6 may be mounted on the bottom plate 20 of the casing 1, and may be spaced apart from each other in the air flow direction (X direction). The pair of guide brackets 5 and 6 may function as guide rails that guide sliding attachment and detachment of the heater module 4. A lower portion of a frame 44 or a guide protrusion 48 of the heater module 4 may be slidably guided by the pair of guide brackets 5 and 6 in a longitudinal direction (Y direction) of the pair of guide brackets 5 and 6.

The door module 7 may open and close the entrance 16. The door module 7 may be rotatably connected to the casing 1 with a hinge H (see FIGS. 1 and 2).

The door module 7 may be mounted with a latch mechanism 8 (see FIG. 3) that may be fastened on the casing 1. The latch mechanism 8 may include a handle 81 (see FIG. 2) which may be held and turned by a hand of the operator and a latch (not shown) connected to the handle 81. The latch (not shown) may be inserted into a latch striker provided around the entrance 16 of the casing 1, and may be fastened to the latch striker in the sliding direction of the heater module 4.

Figure 5:
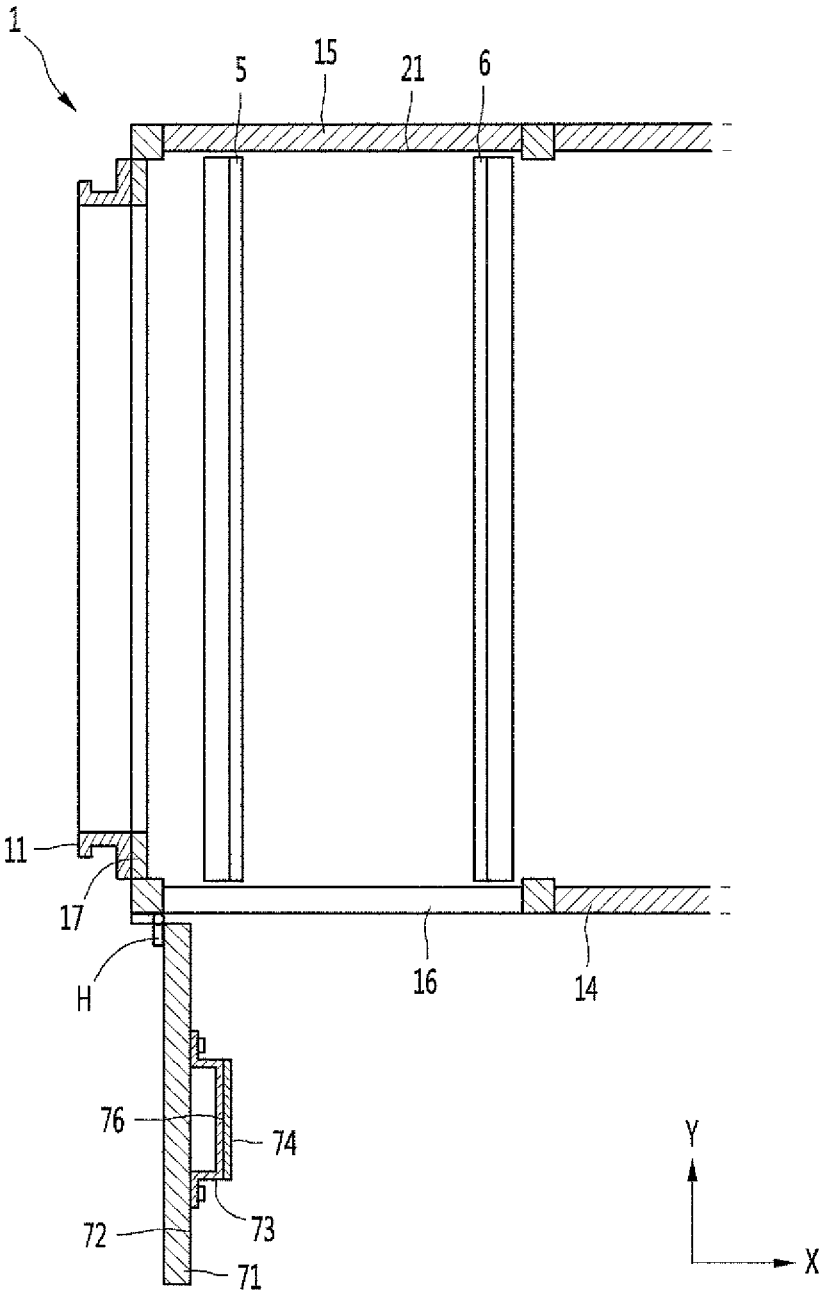
FIG. 5 is a cross-sectional view of an air conditioner according to an embodiment before mounting a heater module therein.
Figure 6:
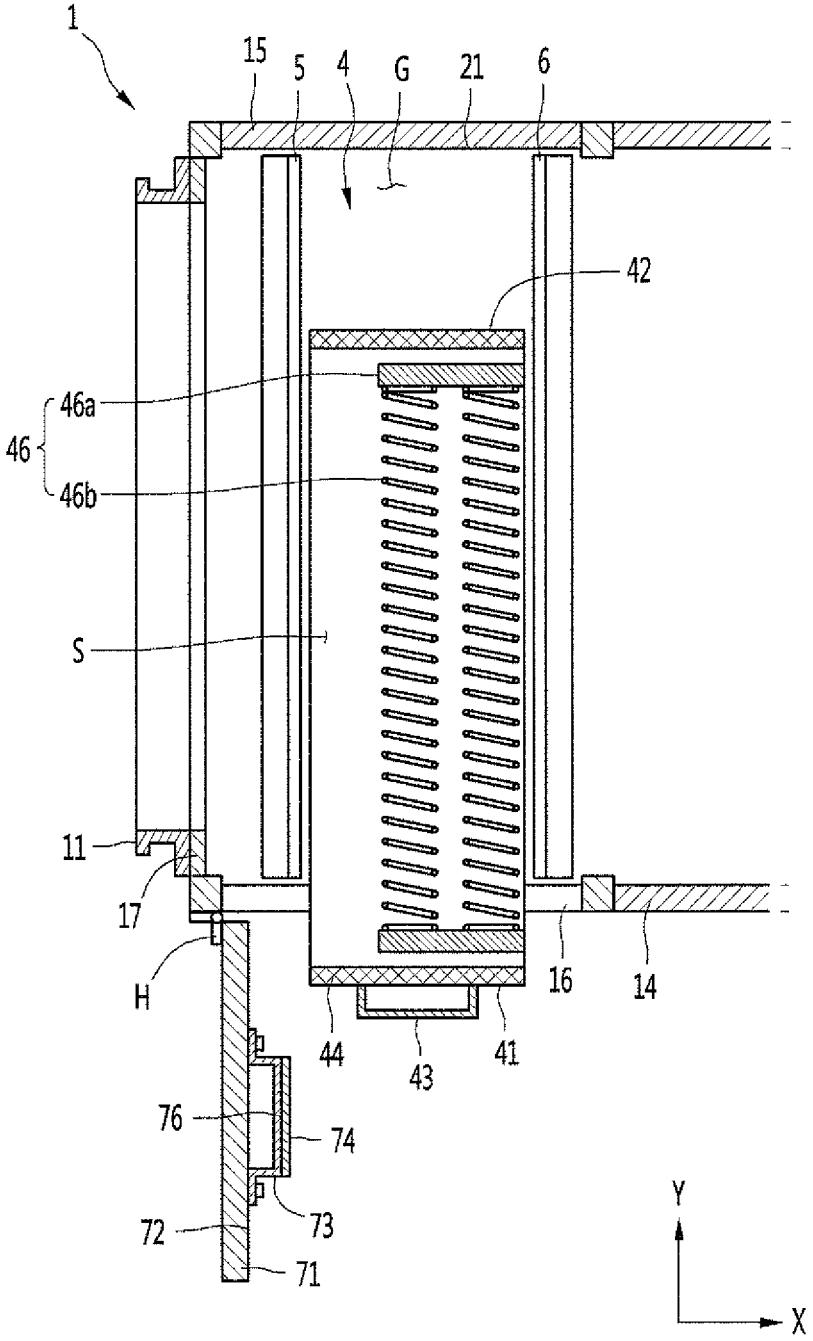
FIG. 6 is a cross-sectional view of an air conditioner according to an embodiment when a heater module is being mounted therein.
Figure 7:
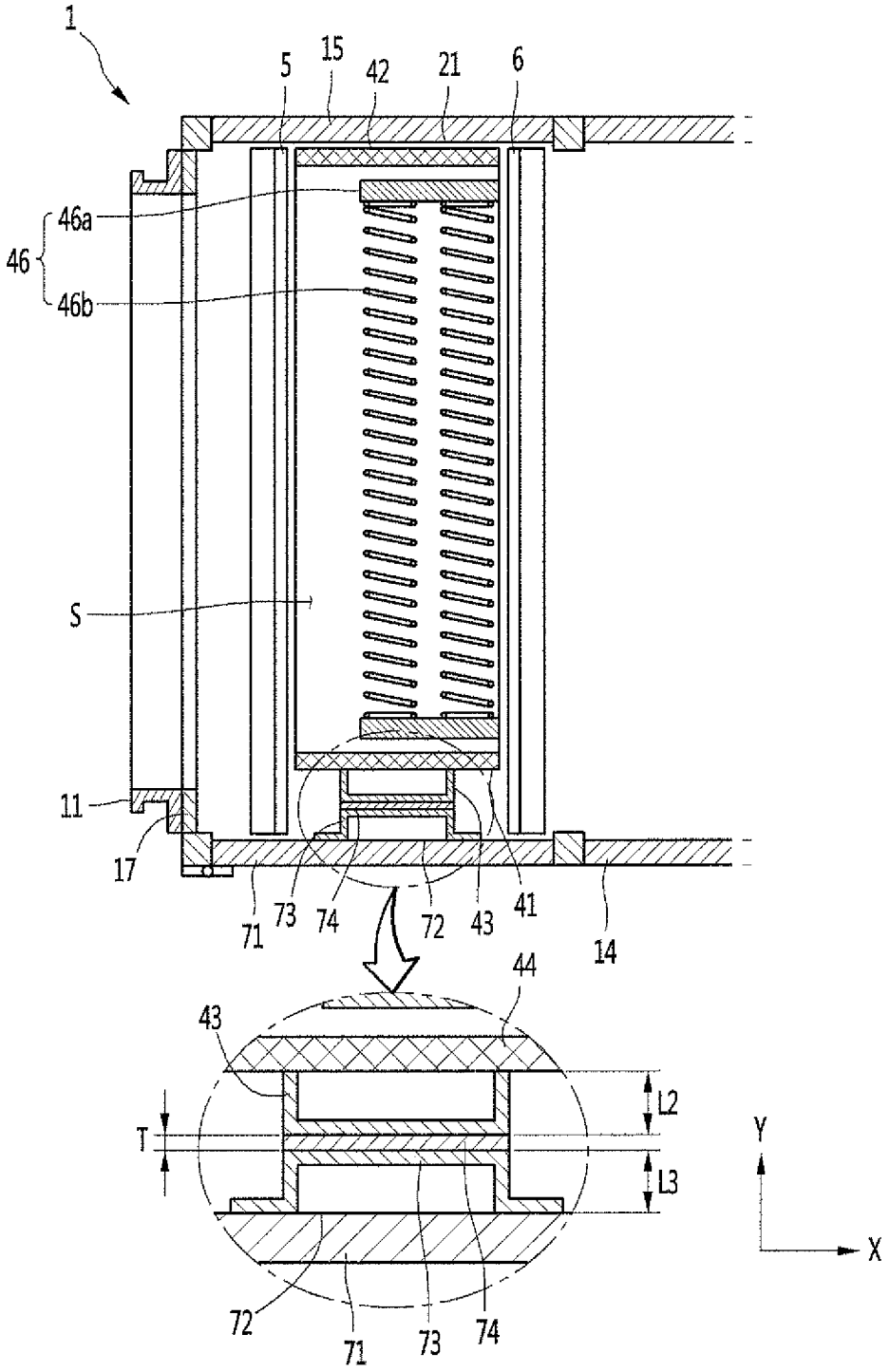
FIG. 7 is a cross-sectional view of an air conditioner according to an embodiment of the present disclosure when a heater module is completely mounted therein.
Figure 8:
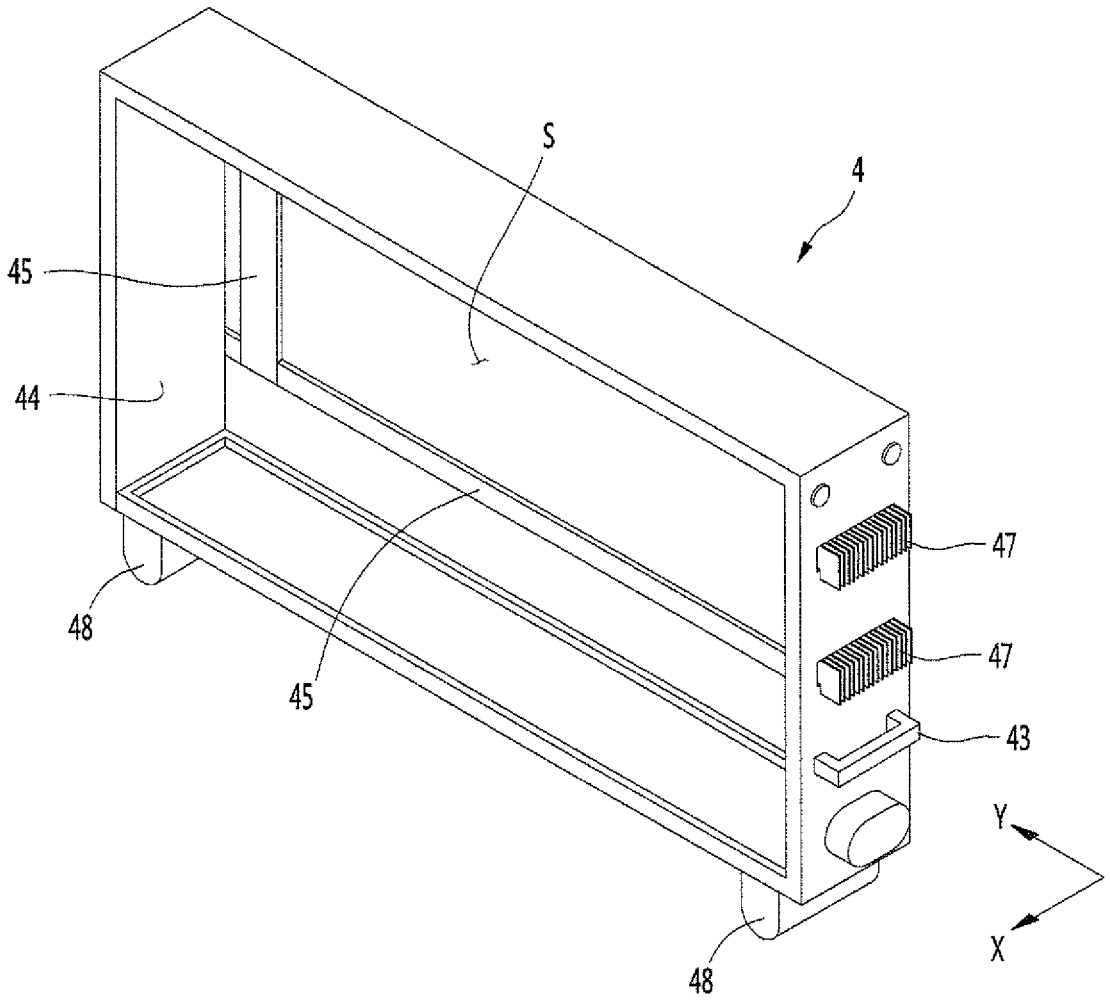
FIG. 8 is a perspective view of a heater module according to an embodiment.
Figure 9:
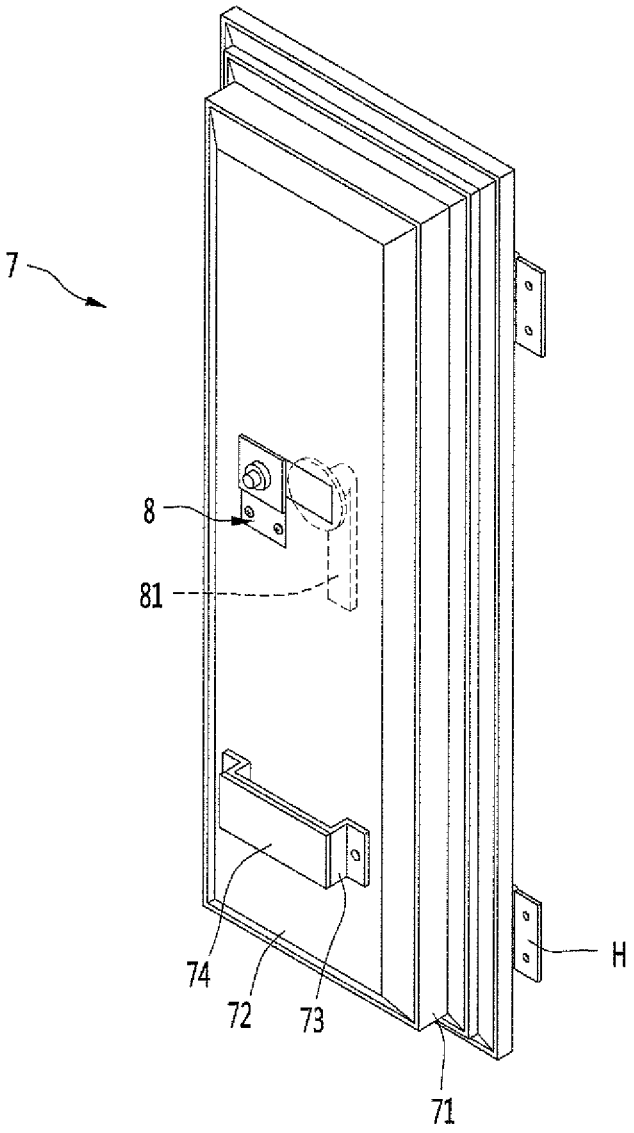
FIG. 9 is a perspective view of a door module according to an embodiment.

FIG. 5 is a cross-sectional view of an air conditioner according to an embodiment before mounting a heater module therein. FIG. 6 is a cross-sectional view of an air conditioner according to an embodiment when a heater module is being mounted therein. FIG. 7 is a cross-sectional view of an air conditioner according to an embodiment when a heater module is completely mounted therein. FIG. 8 is a perspective view of a heater module according to an embodiment. FIG. 9 is a perspective view of a door module according to an embodiment.

The heater module 4 may include the frame 44, a heater mounting bracket 45 mounted on the frame 44, and an electric heater 46 mounted on the heater mounting bracket 45. The heater module 4 may further include one or more terminal block 47 that protrudes from the side surface 41 of the heater module 4 facing the door module 7.

The frame 44 may, for example, have a rectangular shape as a whole. The electric heater 46 may be accommodated between a top frame and a bottom frame, and between a left for first side frame and a right or second side frame. A space S through which the air may pass may be defined in the frame 44. The frame 44 may surround an outer periphery of the electric heater 46, and may be made of an insulating material, such as a synthetic resin, for example.

The guide protrusion 48 (see FIG.8) which is to be in contact with the bottom plate 20 of the casing 1 may protrude from a bottom face of the frame 44. When mounting or removing the heater module 4, the bottom face of the frame 44 may not be in direct face contact with the bottom plate 20 of the casing 1, but a bottom end of the guide protrusion 48 may be in line contact or face contact with the bottom plate 20 of the casing 1.

The guide protrusion 48 may have a curved face convex in a downward direction. Further, the guide protrusion 48 may assist the sliding of the heater module 4 while in contact with the bottom plate 20 of the casing 1 with a minimum contact area.

A protrusion dimension of the guide protrusion 48 may be smaller than a spacing between the pair of guide brackets 5 and 6. Further, the guide protrusion 48 may slide between the pair of guide brackets 5 and 6.

The guide protrusion 48 may include a plurality of guide protrusions on the frame 44. A plurality of guide protrusions 48 may be spaced apart from each other in a sliding direction (Y direction) of the heater module 4.

The heater mounting bracket 45 may be mounted to connect the top frame and the bottom frame of the frame 44 or to connect the left side frame and the right side frame. The electric heater 46 may be attached to and detached from the heater mounting bracket 45 with a fastening member, such as a screw, for example, or a hook member, such as a hook, for example.

The electric heater 46 may include a heater frame **46*a* mounted on the heater mounting bracket 45 and a hot-wire heater 46*b* mounted within the heater frame 46*a*. An inner wire connected to the electric heater 46 and an outer wire extended from a power supply may be connected to the terminal block 47**.

The terminal block 47 may be disposed adjacent to the side face 41 which is close to the entrance 16 among both side faces 41 and 42 of the heater module 4 so as to facilitate connection of the outer wire while the door module 7 is opened.

Further, when the heater module 4 is completely mounted, the side face 42 opposite to the handle 43 among the both side faces 41 and 42 thereof is mounted and brought into contact with the casing 1. Therefore, the terminal block 47 may be arranged with the handle 43 on the side face 41 on which the handle 43 is disposed among the both side faces 41 and 42 of the heater module 4. The both side faces 41 and 42 comprises a first side face 41 and a second side face 42. The first side face 41 is closer to the entrance 16 than the second side face 42. The second side face 42 is opposite to the first side face 41.

The terminal block 47 may have a width such that the terminal block 47 is not in contact with the door module 7 when the door module 7 is closed. A lateral width (Y direction) of the terminal block 47 may be smaller than a sum (L2+T+L3) of a lateral width L2 of the handle 43, a thickness T of the insulating material 74, and a lateral width L3 of the fixed bracket 73 described hereinafter.

The handle 43 of the heater module 4 may have sufficient insulation distance from the terminal block 47. The handle 43 of the heater module 4 may be disposed below and spaced apart from the terminal block 47, as shown in FIG. 8.

The handle 43 may be disposed as low as possible such that the heater module 4 may be cleaned or serviced and may be grabbed by a user comfortably while the air conditioner is mounted on the ceiling. Further, the handle 43 is may be disposed on a lower portion of the side face 41 of the heater module 4 so as to be spaced apart from the terminal block 47 in a vertical direction.

The door module 7 may contact the handle 43 to press the handle 43 toward a face 21 opposite to the entrance 16. The casing 1 may be in a shape in which the face 21 opposite to the entrance 16 is clogged. Upon completion of the mounting of the heater module 4, the face 21 opposite to the entrance 16 may be in contact with the heater module 4.

The door module 7 may include a door body 71 connected to the casing 1 by hinge H, fixed bracket 73 disposed on a face 72 facing inside the casing 1 so as to correspond to the handle 43, and insulating material 74 disposed on a face 76 of the fixed bracket 73 facing the handle 43 and contacting the handle 43.

The fixed bracket 73 is fixed onto an inner face 72 of the door body 71 and has a surface configured to face the handle 43. The fixed bracket 73 may be mounted at a same height as the handle 43. The fixed bracket 73 may be attached to the door body 71 with a fastening member, such as an adhesive, as a screw, for example. When the door body 71 is closed, the insulating material 74 and the fixed bracket 73 may be disposed between the handle 43 and the door body 71, and press the handle 43 in a direction opposite to the entrance 16.

The fixed bracket 73 may have the predetermined width L3 in the left and right or lateral direction. Further, when the heater module 4 is completely mounted, the fixed bracket 73 may support the heater module 4 such that the heater module 4 does not move toward the entrance 16.

The fixed bracket 73 may be made of a metal, such as steel, for example, to ensure sufficient rigidity. The fixed bracket 73 may include a body having a U-shaped cross section and a pair of fasteners that protrudes from the body and fastened to the door body 71. The insulating material 74 is disposed on the surface of the fixed bracket 73 and contacts the handle 43. The insulating material 74 may be made of an insulating material, and may be attached to the face 76 of the fixed bracket 73 closest to the handle 43 using a double sided adhesive, for example.

An air conditioner according to embodiments may minimize a number of components because there is no need for a separate fastening member for fixing a heater module to a casing, and may allow an operator to easily mount the heater module therein.

An air conditioner according to an embodiment may include a casing including a left or first side plate, a right or second side plate, an outdoor air inlet body, and an air outlet body, the casing having an inner air flow space defined therein and an entrance defined in one of the left side plate or the right side plate; a heat exchanger and a fan disposed between the outdoor air inlet body and the air outlet body in an air flow direction of the casing; a heater module inserted through the entrance into the inner air flow space, a handle being mounted on one side face among both side faces of the heater module, one side face of the both side faces being closer to the entrance than the other side face thereof; a pair of guide brackets installed in the casing that slidably guide the heater module; and a door module that opens and closes the entrance. The door module may be configured to contact the handle to press the handle in a direction away from the entrance.

The door module may include a door body connected to the casing; a fixed bracket fixed onto an inner face of the door body and having a surface facing the handle; and an insulating material disposed on the surface of the fixed bracket and contacting the handle. The heater module may further include one or more terminal block that protrudes from a side face of the heater module facing the door module. A lateral width of the terminal block may be smaller than a sum of a lateral width of the handle, a thickness of the insulating material, and a lateral width of the fixed bracket.

The handle may be disposed below and spaced apart from the terminal block.

The heater module may include a frame, a heater mounting bracket mounted on the frame, and an electric heater mounted on the heater mounting bracket. A guide protrusion may be provided protruding from a bottom face of the frame. The protrusion may be in contact with a bottom plate of the casing.

A protrusion dimension of the guide protrusion may be smaller than a spacing between the pair of guide brackets. Further, the guide protrusion may slide between the pair of guide brackets.

The guide protrusion may include a plurality of guide protrusions. Further, the plurality of guide protrusions may be spaced apart from each other in a sliding direction of the heater module.

According to one embodiment, the heater module may be slidably guided by the pair of brackets. Further, the door module that opens and closes the entrance for inserting the heater module may press the heater module to fix the heater module. Therefore, an operation to fix the heater module inside the casing by a screw, for example, is not necessary. Further, the heater module may be easily mounted with a simple operation that the operator pushes the heater module into the entrance and closes the door module.

Hereinabove, although embodiments have been described with reference to exemplary embodiments, embodiments are not limited thereto, but may be variously modified and altered by those skilled in the art to which the embodiments pertains without departing from the spirit and scope.

Therefore, embodiments are provided to explain the spirit and scope, but not to limit them, so that the spirit and scope is not limited by the embodiments. The scope should be construed on the basis of the accompanying claims, and all the technical ideas within the scope equivalent to the claims should be included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a casing including a first side plate, a second side plate, an outdoor air inlet body, and an air outlet body, the casing having an inner air flow space defined therein and an entrance defined in one of the first side plate or the second side plate;

at least one heat exchanger and a fan disposed between the outdoor air inlet body and the air outlet body in an air flow direction of the casing;

a heater module inserted through the entrance into the inner air flow space, wherein a handle is mounted on a first side face of the heater module, and wherein the first side face is closer to the entrance than a second side face thereof;

a pair of guide brackets installed in the casing that slidably guide the heater module; and a door module that opens and closes the entrance, wherein the door module is configured to contact the handle to press the handle in a direction away from the entrance.

2. The air conditioner of claim 1, wherein the door module includes:

a door body connected to the casing;

a fixed bracket fixed onto an inner face of the door body and having a surface configured to face the handle; and an insulating material disposed on the surface of the fixed bracket and contacting the handle.

3. The air conditioner of claim 2, further comprising at least one terminal block that protrudes from the first side face of the heater module, wherein a lateral width of the at least one terminal block is smaller than a sum of a lateral width of the handle, a thickness of the insulating material, and a lateral width of the fixed bracket.

4. The air conditioner of claim 3, wherein the handle is disposed below and spaced apart from the at least one terminal block.

5. The air conditioner of claim 1, wherein the heater module includes:

a frame;

a heater mounting bracket mounted on the frame; and an electric heater mounted on the heater mounting bracket, wherein at least one guide protrusion protrudes from a bottom face of the frame, wherein the at least one protrusion is in contact with a bottom plate of the casing.

6. The air conditioner of claim 5, wherein a protrusion dimension of the at least one guide protrusion is smaller than a spacing between the pair of guide brackets, and wherein the at least one guide protrusion slides between the pair of guide brackets.

7. The air conditioner of claim 5, wherein the at least one guide protrusion includes a plurality of guide protrusions, and wherein the plurality of guide protrusions is spaced apart from each other in a sliding direction of the heater module.

8. The air conditioner of claim 1, wherein the door module is rotatably attached to the casing by at least one hinge.

9. The air conditioner of claim 1, wherein the heater module is configured to be inserted into the inner air flow space at a position adjacent the outdoor air inlet body.

10. An air conditioner, comprising:

a casing including an outdoor air inlet body and an air outlet body, the casing having an inner air flow space defined therein;

at least one heat exchanger and a fan disposed between the outdoor air inlet body and the air outlet body in an air flow direction of the casing;

a heater inserted through an opening in the casing into the inner air flow space, wherein a handle is mounted on a side face of the heater;

a pair of guide brackets installed in the casing that slidably guide the heater; and a door rotatably attached to the case that opens and closes the opening, wherein the door is configured to contact the handle to press the handle in a direction away from the opening.

11. The air conditioner of claim 10, wherein the door includes:

a door body connected to the casing;

a fixed bracket fixed onto an inner face of the door body and having a surface configured to face the handle; and an insulating material disposed on the surface of the fixed bracket and contacting the handle.

12. The air conditioner of claim 11, further comprising at least one terminal block that protrudes from the side face of the heater, wherein a lateral width of the at least one terminal block is smaller than a sum of a lateral width of the handle, a thickness of the insulating material, and a lateral width of the fixed bracket.

13. The air conditioner of claim 12, wherein the handle is disposed below and spaced apart from the at least one terminal block.

14. The air conditioner of claim 10, wherein the heater includes:

a frame;

a heater mounting bracket mounted on the frame; and an electric heater mounted on the heater mounting bracket, wherein at least one guide protrusion protrudes from a bottom face of the frame, wherein the at least one protrusion is in contact with a bottom plate of the casing.

15. The air conditioner of claim 14, wherein a protrusion dimension of the at least one guide protrusion is smaller than a spacing between the pair of guide brackets, and wherein the at least one guide protrusion slides between the pair of guide brackets.

16. The air conditioner of claim 6, wherein the at least one guide protrusion includes a plurality of guide protrusions, and wherein the plurality of guide protrusions is spaced apart from each other in a sliding direction of the heater.

17. The air conditioner of claim 10, wherein the door is rotatably attached to the casing by at least one hinge.

18. The air conditioner of claim 10, wherein the heater is configured to be inserted into the inner air flow space at a position adjacent the outdoor air inlet body.

19. An air conditioner, comprising:

a casing including an outdoor air inlet body and an air outlet body, the casing having an inner air flow space defined therein;

at least one heat exchanger and a fan disposed between the outdoor air inlet body and the air outlet body in an air flow direction of the casing;

a heater inserted through an opening in the casing into the inner air flow space, wherein a handle is mounted on a side face of the heater; and a door rotatably attached to the case that opens and closes the opening, wherein the door is configured to contact the handle to press the handle in a direction away from the opening.

20. The air conditioner of claim 19, wherein the door includes:

a door body connected to the casing;

a fixed bracket fixed onto an inner face of the door body and having a surface configured to face the handle; and an insulating material disposed on the surface of the fixed bracket and contacting the handle.

* * * * *